US009377168B2

(12) United States Patent
Van Der Wel

(10) Patent No.: US 9,377,168 B2
(45) Date of Patent: Jun. 28, 2016

(54) COMPACT LIGHT OUTPUT DEVICE WITH WAVELENGTH CONVERSION

(71) Applicant: Koninklijke Philips N.V., Eindhoven (NL)

(72) Inventor: Pieter Joseph Clara Van Der Wel, Heerlen (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/354,469

(22) PCT Filed: Oct. 30, 2012

(86) PCT No.: PCT/IB2012/055999

§ 371 (c)(1),
(2) Date: Apr. 25, 2014

(87) PCT Pub. No.: WO2013/064969

PCT Pub. Date: May 10, 2013

(65) Prior Publication Data

US 2014/0307416 A1 Oct. 16, 2014

Related U.S. Application Data

(60) Provisional application No. 61/553,299, filed on Oct. 31, 2011.

(51) Int. Cl.

| | |
|---|---|
| ***F21K 99/00*** | (2010.01) |
| ***F21V 3/00*** | (2015.01) |
| *F21Y 101/02* | (2006.01) |
| *F21Y 103/00* | (2016.01) |

(52) U.S. Cl.

CPC ... *F21K 9/56* (2013.01); *F21K 9/17* (2013.01); *F21K 9/90* (2013.01); *F21V 3/00* (2013.01); *F21Y 2101/02* (2013.01); *F21Y 2103/003* (2013.01); *Y10T 29/49117* (2015.01)

(58) Field of Classification Search

CPC ..... F21K 9/10; F21K 9/17; F21K 9/175; F21K 9/58

USPC ..... 362/84, 583, 558, 217.02, 217.04, 244, 362/246

See application file for complete search history.

(56) References Cited

U.S. PATENT DOCUMENTS

| | | | | |
|---|---|---|---|---|
| 7,543,957 | B1 | 6/2009 | Balazs et al. | |
| 8,033,706 | B1 * | 10/2011 | Kelly et al. | 362/607 |
| 8,449,150 | B2 * | 5/2013 | Allen et al. | 362/311.06 |
| 2004/0264187 | A1 | 12/2004 | Vanderschuit | |
| 2005/0174770 | A1 * | 8/2005 | Ratcliffe | 362/240 |
| 2005/0269560 | A1 | 12/2005 | Oku | |
| 2006/0203468 | A1 * | 9/2006 | Beeson et al. | 362/84 |
| 2009/0231833 | A1 * | 9/2009 | Miki et al. | 362/84 |
| 2010/0139165 | A1 * | 6/2010 | Oyama | 47/1.1 R |
| 2010/0177532 | A1 * | 7/2010 | Simon et al. | 362/555 |
| 2010/0265693 | A1 * | 10/2010 | Ryu et al. | 362/84 |

(Continued)

FOREIGN PATENT DOCUMENTS

| | | | |
|---|---|---|---|
| DE | 202005005135 | U1 | 7/2005 |
| JP | 2000182404 | A | 6/2000 |

(Continued)

*Primary Examiner* — Robert May
*Assistant Examiner* — Bryon T Gyllstrom

(57) ABSTRACT

A light output device (100) comprising: a light generating unit comprising at least one solid state light source (102); at least two sealed transparent tubes (108) each enclosing wavelength converting material (110), arranged adjacent to each other, in such a way that an elongated cavity is formed between the transparent tubes, wherein the light generating unit is arranged to emit light into the elongated cavity.

16 Claims, 3 Drawing Sheets

(56) References Cited

U.S. PATENT DOCUMENTS

| | | | | |
|---|---|---|---|---|
| 2010/0321921 | A1* | 12/2010 | Ivey | 362/84 |
| 2011/0149548 | A1* | 6/2011 | Yang et al. | 362/84 |
| 2011/0175546 | A1* | 7/2011 | Ramer et al. | 315/294 |
| 2011/0228517 | A1* | 9/2011 | Kawabat et al. | 362/84 |
| 2012/0300431 | A1* | 11/2012 | You et al. | 362/84 |

FOREIGN PATENT DOCUMENTS

| | | | | | |
|---|---|---|---|---|---|
| WO | 02062106 | A1 | | 8/2002 | |
| WO | 2004036618 | A1 | | 4/2004 | |
| WO | 2005012785 | A1 | | 2/2005 | |
| WO | WO 2006114740 | A2 | * | 11/2006 | G02B 6/00 |
| WO | 2006133771 | A1 | | 12/2006 | |
| WO | 2007006265 | A2 | | 1/2007 | |
| WO | 2008028857 | A1 | | 3/2008 | |
| WO | 2008090507 | A1 | | 7/2008 | |
| WO | 2011132120 | A1 | | 10/2011 | |
| WO | 2012001584 | A1 | | 1/2012 | |
| WO | 2012001645 | A1 | | 1/2012 | |
| WO | 2012063174 | A2 | | 5/2012 | |

* cited by examiner

COMPACT LIGHT OUTPUT DEVICE WITH WAVELENGTH CONVERSION

FIELD OF THE INVENTION

The present invention relates to a light output device comprising wavelength converting material and to a method for manufacturing a light output device.

BACKGROUND OF THE INVENTION

Retrofit solutions allowing the use of light emitting diode (LED) devices in existing modules and fixtures for tubular lighting (TL) is an increasingly attractive alternative in order to improve the power efficiency of existing lighting systems.

To achieve a retrofit lighting device, it is known to arrange an LED module inside a sealed glass tube. In such a device, the inner surface of the glass tube is commonly coated with a phosphor material for wavelength conversion of light emitted from the LED device which tends to be towards the blue region of the visible spectra. Furthermore, it has been found that it is advantageous to use organic phosphor materials which have been shown to exhibit an increased lifetime compared to previously used wavelength converting materials. However, organic phosphors are sensitive to ambient air and it has been shown that organic phosphors in a sealed environment have a markedly longer lifetime. Therefore, it is important that the glass tube is properly sealed.

Known methods for sealing a glass tube for tubular lighting applications include standard lamp sealing techniques requiring an annealing step. Such an annealing step may result in that the surface of the lamp is heated over a large area. However, high temperatures treatments are not compatible with organic phosphor polymers. In an alternative approach, the glass tubes may be sealed by gluing a cap to the end of the tube. A drawback of the glued seal is that it is not as air-tight as a glass seal and the increased complexity of such a manufacturing method makes the glued seal less suitable for mass production.

Accordingly, there is need for a tubular lighting LED retrofit device and an improved method for manufacturing such a device facilitating the use of organic phosphorus materials.

SUMMARY OF THE INVENTION

It is an object of the present invention to provide an improved light output device and to overcome the aforementioned drawbacks.

According to a first aspect of the invention, this and other objects are achieved by a light output device comprising a light generating unit comprising at least one solid state light source, at least two sealed transparent tubes each enclosing wavelength converting material, arranged adjacent to each other, in such a way that an elongated cavity is formed between the transparent tubes, wherein the light generating unit is arranged to emit light into the elongated cavity.

The present invention is based on the realization that arranging the light generating unit outside of the transparent tubes comprising the wavelength converting material allows the use of tubes having a sufficiently small diameter so that the tubes may be sealed on themselves without the use of a flange arranged at the end of the tube. The use of a flange can be avoided as no electrical feedthroughs are required to pass from the outside to the inside of the tube. By avoiding the use of a flange, the high temperature annealing step commonly required to seal the tube may be avoided. This is particularly advantageous as it allows the use of organic phosphor materials which are incompatible with the high temperatures used in the annealing step. Furthermore, arranging the light generating unit outside of the tubes allows for a compact light output device as the tubes may be made smaller than would be possible otherwise.

The specific diameter for which it is possible to seal the tubes without the use of a flange will depend on fabrication parameters such as tube material and the thickness of the tube walls.

The wavelength converting material converts the wavelengths of the light emitted by the solid state light source into wavelengths desirable for the particular application at hand such as for example office-lighting, mood-lighting or colored-lighting applications.

In one embodiment of the invention, the at least two sealed transparent tubes may preferably be substantially straight and arranged in parallel with each other. A straight-forward way to form a cavity into which light is emitted by the light generating unit is to arrange two elongated essentially circular transparent tubes of equal length in parallel and adjacent to each other. The term cavity should in the present context be understood as any recess, indentation, groove, trench or the like formed by arranging at least two tubes adjacent to each other. However, three or more tubes may equally well be used to form at least one cavity. Furthermore, several light generating units may be used to emit light into different cavities in arrangements comprising a plurality of tubes and cavities. Furthermore, the transparent tubes must not be straight, they may for example be donut shaped, have an S-shape or be curved in any other way. Additionally, a recess formed by arranging at least two tubes in proximity of each other may equally well be possible.

In one embodiment of the invention, the at least one solid state light source may preferably be arranged on a light source carrier.

Furthermore, the light source carrier may advantageously be arranged adjacent to the at least two sealed transparent tubes so that light sources arranged on the light source carrier are enclosed by the light source carrier and the at least two transparent tubes. Furthermore, using a light source carrier and arranging the carrier adjacent to the transparent tubes so that the light sources are confined in the enclosure formed by the transparent tubes and the carrier is advantageous as it provides for a short light-path between the light source and the wavelength converting material. The carrier may for example be a printed circuit board (PCB) or a metal foil. Furthermore, the carrier may advantageously be flexible which makes it easy to arrange the carrier adjacent to for example circular transparent tubes.

According to one embodiment of the invention, a plurality of solid state light sources may preferably be arranged along the length of the sealed transparent tubes. Thereby, a homogeneous light output can be achieved which resembles the output from a conventional tubular light source.

Furthermore, the enclosure formed by the light source carrier and the at least two transparent tubes may advantageously be filled with an optical bonding material. An optical bonding material reduces losses in the transmission of light from the light source to the wavelength converting material by eliminating the air gap which may otherwise be present between the light generating unit and the transparent tubes. The optical bonding material may preferably have a refractive index such that refraction is minimized in the transitions from the light emitting diode to the wavelength converting material.

In one embodiment of the invention, at least one of the transparent tube and the wavelength converting material is configured to scatter light emitted by the light emitting diode.

Scattering of the light may improve light extraction for example in that the distribution of the emitted light is more homogeneous. The scatterer may for example be provided in the form of a scattering element comprised in the wavelength converting material or as a rough surface of the transparent tube. Further optical elements such as reflectors, lenses and diffusers are of course also possible to alter the behavior of the emitted light.

In one embodiment of the invention, the wavelength converting material may preferably comprise an organic phosphor polymer. Organic phosphors have the advantage that their luminescence spectrum can be easily adjusted with respect to position and band width. Furthermore, organic phosphor materials also often have a high degree of transparency, which is advantageous since the efficiency of the light extraction is improved compared to systems using more light-absorbing and/or reflecting inorganic phosphor materials. Moreover, the stability and lifetime of organic wavelength converting molecules may be improved by incorporating the molecules in a polymeric material. Additionally, organic phosphors are generally much less costly than inorganic phosphors.

Furthermore, the wavelength converting material may advantageously be provided in the form of a solid rod. An advantage of using a rod is that by providing the wavelength converting material in a volume the concentration of organic phosphor material can be lowered which is known to result in extended lifetime of the phosphor. However, the wavelength converting material may alternatively be provided in the form of a foil or a coating on the inner surface of the sealed transparent tubes.

In embodiments of the present invention, the solid state light source may preferably be a light emitting diode (LED). However, other solid state light sources such as laser diodes may also be used.

According to one embodiment of the invention, the transparent tube may advantageously be a glass tube. Glass is advantageously used as it is cheap, abundant and in that methods for manufacturing and handling glass are established and well known, in particular in the lighting industry. The use of glass tubes facilitates the sealing of the tubes through a heating step where the ends of the tubes are melted so as to sealing the tubes.

Furthermore, the light output device according to embodiments of the invention may advantageously be arranged at least partly within a transparent tube, thereby forming a luminaire suitable for use as a TL retrofit light module. By arranging the light output device in a tube, additional electrical protection is provided. Furthermore, the transparent tube may for example be a polymer tube or a glass tube having a diameter matching that of existing fixtures for tubular lighting for providing a retrofit TL arrangement.

According to a second aspect of the invention, there is provided a method for manufacturing a light output device comprising the steps of: providing a light generating unit comprising at least one solid state light source; providing at least two transparent tubes; inserting wavelength converting material into the at least two transparent tubes; evacuating any air from the tubes; sealing the at least two transparent tubes by heating the ends of the tubes; arranging the at least two sealed transparent tubes in parallel and adjacent to each other in such a way that an elongated cavity is formed between the transparent tubes; and arranging the light generating unit so that light from the at least one solid state light source is emitted into the elongated cavity.

By using the aforementioned manufacturing method, the complexity of manufacturing a tubular light source is reduced compared to methods known in the art. For example, the use of metal flange may be avoided, thereby reducing the number of components needed. Furthermore, an air tight seal is achieved without the need for annealing the tube at elevated temperatures, thus facilitating the use of organic phosphor based wavelength converting materials.

Further effects and features of this second aspect of the present invention are largely analogous to those described above in connection with the first aspect of the invention.

It is noted that the invention relates to all possible combinations of features recited in the claims.

BRIEF DESCRIPTION OF THE DRAWINGS

These and other aspects of the present invention will now be described in more detail, with reference to the appended drawings showing an embodiment of the invention.

DETAILED DESCRIPTION

In the present detailed description, various embodiments of a light output device according to the present invention are mainly discussed with reference to an elongated light output device comprising light emitting diodes (LEDs). It should be noted that this by no means limits the scope of the present invention which is equally applicable to light output devices having other shapes and using alternative light sources such as laser diodes.

Figure 1:
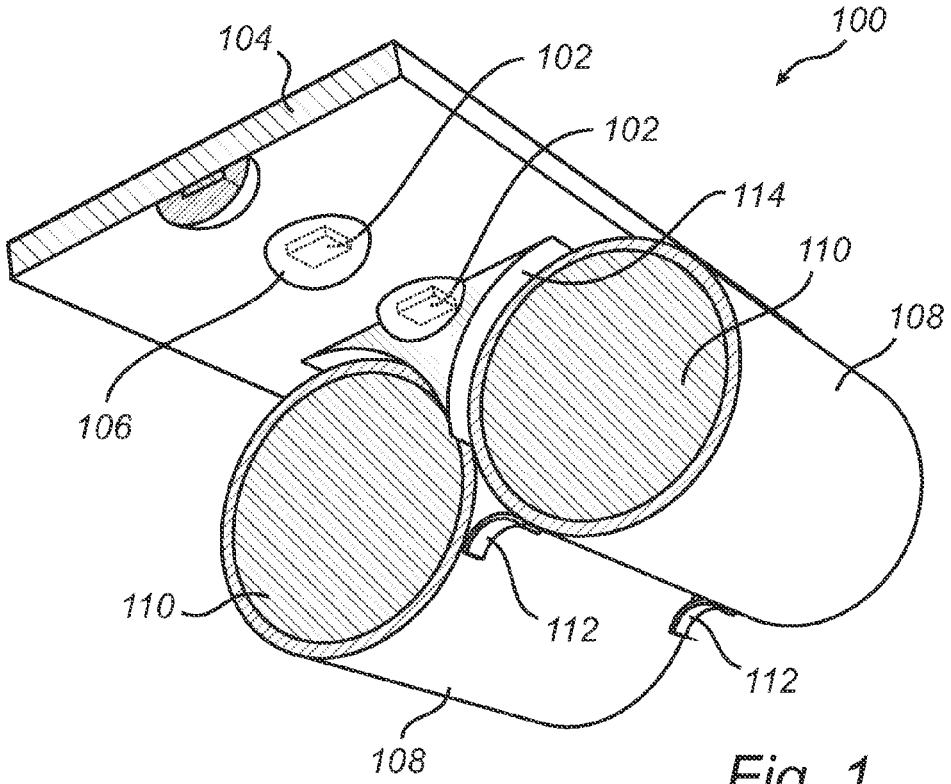
FIG. 1 schematically illustrates a light output device according to an embodiment of the present invention.

FIG. 1 schematically illustrates a cross sectional view of a light output device 100 according to an embodiment of the invention. Solid state light sources, here in the form of light emitting diode (LED) dies 102, are arranged on a LED carrier 104. Preferably, a chip-on-board technology where the LED dies 102 are attached and wire bonded to the LED carrier 104 may be used for the LEDs as an LED arrangement having a small size is preferable. The LED carrier 104 can for example be a PCB or it may be based on a flexible material such as a metal foil, a flex circuit or a flexible PCB. The LED dies 102 may be protected by a transparent glob top 106. Two sealed essentially circular glass tubes 108, each enclosing a solid polymer rod comprising wavelength converting material 110 are arranged adjacent to each other and in parallel, in such a way that an elongated cavity is formed between the two glass tubes 108. The LED carrier 104 is arranged adjacent to the tubes 108 so that the LEDs emit light into the cavity and towards the tubes 108. If necessary a mechanical assembly piece such as a clip 112 may be added. Furthermore, the elongated cavity is filled with an optical bonding material 114 to provide good optical contact between the LEDs and the wavelength converting material 110. The optical bonding material may be an optically transparent silicone or any other sort of optical bonding material having a suitable refractive index and being able to endure elevated temperatures.

LEDs commonly emit light in the blue region of the visible spectra and in order to convert the blue light to wavelengths more suitable for general lighting purposes, a wavelength converting material in the form of an organic phosphor is used. The blue light excites the phosphor which then emits light of longer wavelengths, thereby providing a more white/yellow light.

Figure 2:
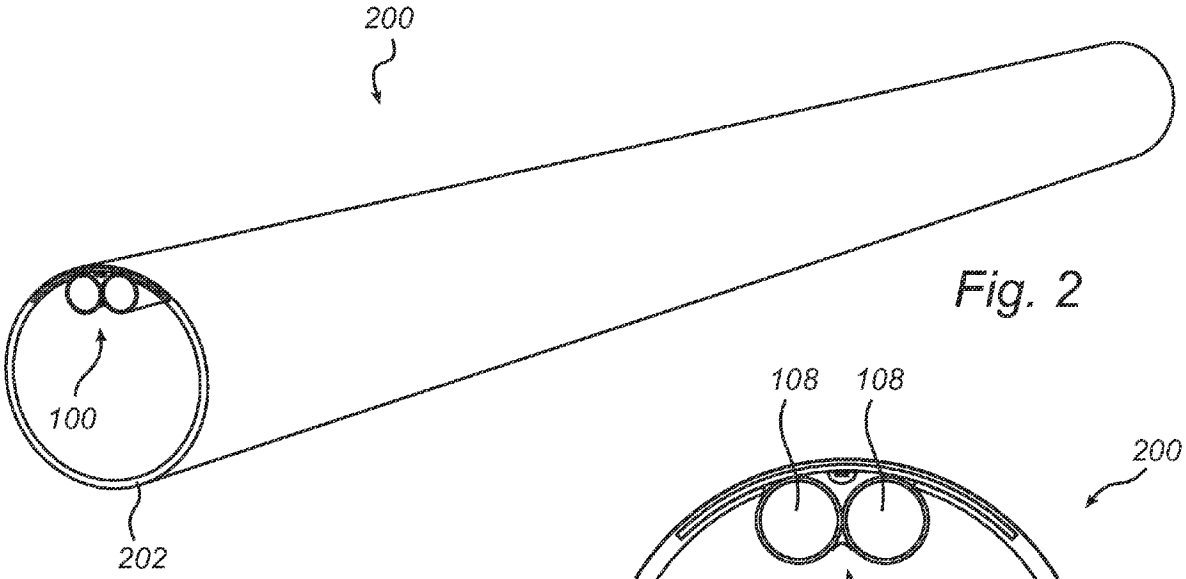
FIG. 2 schematically illustrates a luminaire according to an embodiment of the present invention.
Figure 3:
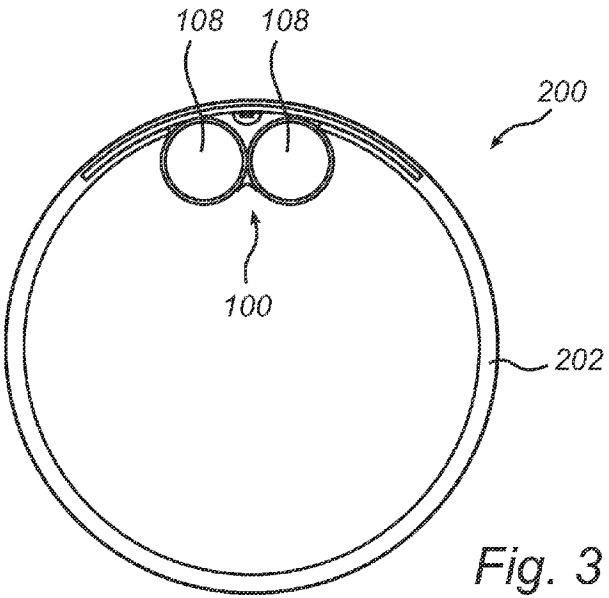
FIG. 3 schematically illustrates a cross section of a luminaire according to an embodiment of the present invention.

FIG. 2 is a schematic illustration of a luminaire 200 according to an embodiment of the invention and FIG. 3 is a schematic illustration of a cross-section of a luminaire 200 in which the light output device 100 is enclosed in a transparent tube 202 of larger diameter. The enclosing transparent tube 202 provides additional electrical and thermal insulation which may be required when retrofitting the luminaire in a tubular lighting assembly. The enclosing transparent tube 202 may for example be a plastic, polymer or glass tube. Due to the relatively small size of the light output device, it can for example be integrated in an enclosing tube 202 suitable for a TLD or T5 lighting system. Alternatively, the light output device may be used as is, thereby providing a very compact luminaire.

The diameter of the glass tubes 108 is relatively small so that the tube can be sealed by a process of heating while or after any remaining air is evacuated from the tube. This kind of seal does not require any further annealing, thereby facilitating the use of temperature sensitive phosphor materials. Furthermore, the equipment required for such a sealing method is less complex than what is needed for sealing glass tubes having larger diameters where the use of a flange is required. In the case where the glass tubes 108 are to be enclosed in a tube 202, each of the two tubes must have a diameter no larger than half of the inner diameter of the enclosing tube 202. For example, for an enclosing tube 202 the size of a T5 tube, having a diameter of 15.875 mm and assuming a glass thickness of 1 mm, the diameter of the glass tubes 108 should be less than approximately 7 mm.

In an alternative approach, glass tubes 108 having a larger diameter may also be used. As stated above, larger diameter glass tubes may require a flange to be sealed. However, the flange traditionally contained the metal feedthrough for the electrodes in a gas discharge lamp. As the tube in the present application is not intended for a gas discharge lamp, the metal feedthrough can be omitted and the flange glass thickness can easier be made to match the thickness of the glass tube. When sealing a flange and a tube with matching glass thickness, the residual stress in the seal is much lower and the annealing step can be more limited or it may even be omitted, thereby facilitating the use of temperature sensitive organic phosphor materials. If the glass tubes are to be integrated in an enclosing tube 202 suitable for a T12 fixture having a diameter of 38.1 mm, the diameter of the tubes 108 should be no larger than approximately 18 mm, given the assumption of a 1 mm thickness of the enclosing tube 202. However, in the case when no enclosing tube 202 is used, the diameter of the tubes 108 may be chosen arbitrarily.

Figure 4:
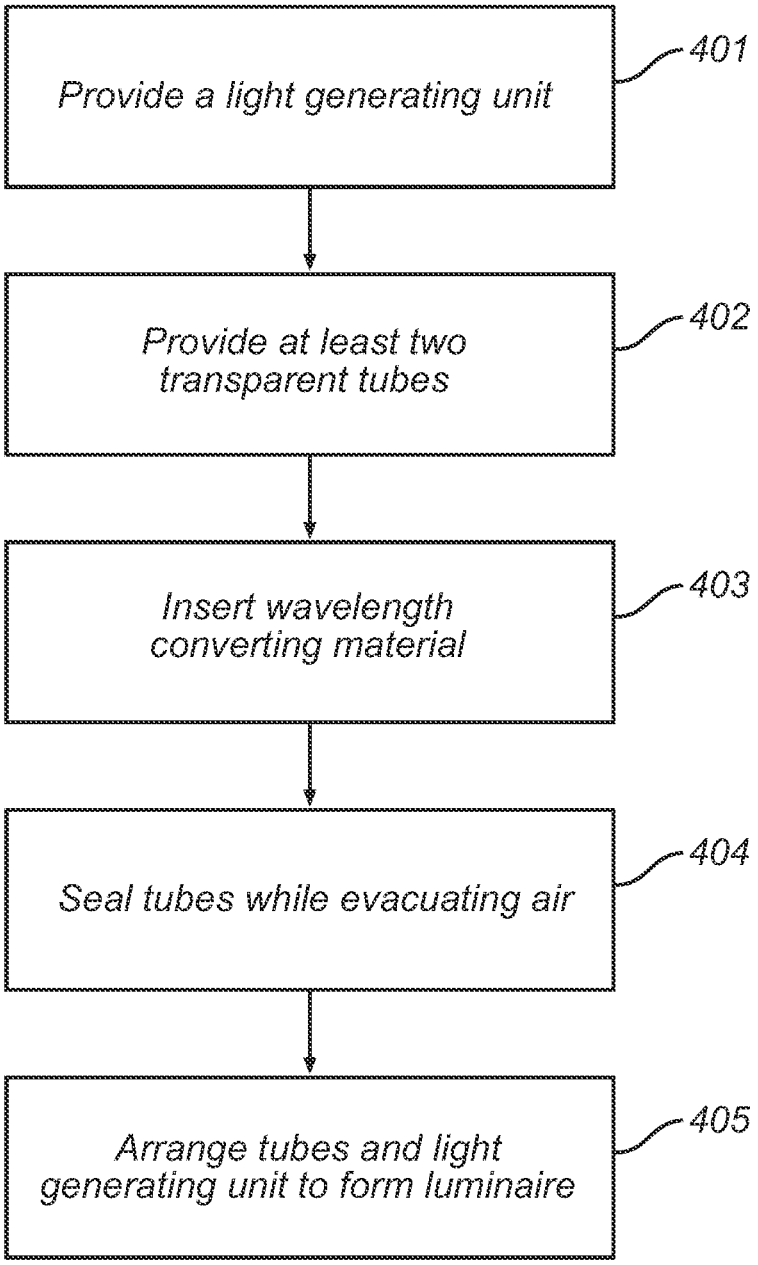
FIG. 4 is a flow chart outlining the general steps of a method for manufacturing a light output device according to an embodiment of the present invention.

FIG. 4 is a flow chart outlining the general steps of a method for manufacturing a light output device 100 according to an embodiment of the invention. First, in step 401, a light generating unit according to embodiments of the light generating unit described above is provided. The light generating unit is elongated and comprises light emitting diode dies 102 that are wire bonded to a carrier 104 made from a flexible material. In step 402, at least two transparent tubes 108 are provided, in one embodiment the transparent tubes are glass tubes. Next, in step 403, wavelength converting material 110 in the form of an organic phosphor material comprised in a polymer rod is inserted in each of the glass tubes 108. After inserting the rods, in step 404, the tubes 108 are sealed by locally heating the ends of the tubes so that they are sealed "on themselves" without the use of additional components such as a flange. As the tubes 108 are being sealed, any remaining air in the tubes is being evacuated in order to improve the performance and increase the life time of the wavelength converting material. The air may be evacuated either prior to sealing the tubes or during the sealing process. Finally, in step 405, the two tubes 108 are arranged in parallel and adjacent to each other so that an elongated cavity is formed between the two tubes 108. The elongated light generating unit is arranged so that the light emitting diodes 102 emit light into the cavity. Preferably, the light generating unit is arranged so that the distance from the light emitting diodes 102 to the tubes 108 are minimized in order to reduce losses as light travels from the light emitting diode 102 to the wavelength converting material 110. To further reduce loss of light, any space between the light emitting diodes and the tubes is filled by an optical bonding material 114 having a refractive index such that refraction at the interfaces between the optical bonding material and the neighboring materials is kept to a minimum. Furthermore, the light output device 100 may be arranged in a transparent tubular sleeve 202 of relatively larger diameter as illustrated in FIGS. 2 and 3 for additional electrical and thermal protection or to adapt the luminaire to fit in existing tubular lighting fixtures.

The person skilled in the art realizes that the present invention by no means is limited to the preferred embodiments described above. On the contrary, many modifications and variations are possible within the scope of the appended claims. For example, luminaires comprising three or more tubes may equally well be used, and the tubes do not have to be neither circular nor straight, they may be provided in any form and shape suitable for a specific application. Additionally, the at least two transparent tubes must not be in direct contact with each other, other arrangements where the tubes are separated by an intermediate material or by an air gap are equally possible. Furthermore, additional optical elements such as reflectors, diffusers and other elements known in the art may be incorporated in or used in combination with embodiments of the present invention. Moreover, the steps of the method according to embodiments of the present invention must not be performed in the specific order in which they are stated.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage.

The invention claimed is:

1. A light output device comprising:

a light generating unit comprising at least one solid state light source;

at least two sealed transparent circular tubes each enclosing wavelength converting material, arranged adjacent to and adjoining each other, in such a way that an elongated and enclosed cavity is formed between said transparent circular tubes, wherein said light generating unit is arranged to emit light into said elongated and enclosed cavity formed between said transparent circular tubes, wherein the at least one solid state light source is arranged on a light source carrier, and wherein the light source carrier is arranged adjacent to the at least two sealed transparent tubes so that light sources arranged on the light source carrier are enclosed by the light source carrier and the at least two transparent tubes.

2. The light output device according to claim 1, wherein the at least two sealed transparent tubes are substantially straight and arranged in parallel with each other.

3. The light output device according to claim 1, wherein a plurality of solid state light sources are arranged along the length of the sealed transparent tubes.

4. The light output device according to claim 3, wherein the enclosure formed by the light source carrier and the at least two transparent tubes is filled with an optical bonding material.

5. The light output device according to claim 4, wherein at least one of the transparent tube and the wavelength converting material is configured to scatter light emitted by the light source.

6. The light output device according to claim 5, wherein the wavelength converting material comprises an organic phosphor polymer.

7. The light output device according to claim 6, wherein the wavelength converting material is provided in the form of a solid rod.

8. The light output device according to claim 7, wherein the solid state light source is a light emitting diode (LED).

9. The light output device according to claim 8, wherein each of the transparent tubes is a glass tube.

10. A luminaire, wherein a light output device according to claim 8 is arranged at least partly within an enclosing transparent tube.

11. The light output device according to claim 1, wherein said cavity is completely enclosed.

12. The light output device according to claim 1, wherein the at least one solid state light source is arranged on a light source carrier, and wherein the light source carrier is arranged adjacent to and adjoining the at least two sealed transparent tubes so that the at least one solid state light source is confined in an enclosure formed by the light source carrier and the at least two transparent tubes.

13. A method for manufacturing a light output device comprising the steps of:

providing a light generating unit comprising at least one solid state light source;

providing at least two transparent circular tubes;

inserting wavelength converting material into said at least two transparent circular tubes;

evacuating any air from the tubes;

sealing said at least two transparent circular tubes by heating the ends of the tubes;

arranging said at least two sealed transparent circular tubes adjacent to and adjoining each other in such a way that an elongated and enclosed cavity is formed between said transparent circular tubes;

arranging said light generating unit so that light from said at least one solid state light source is emitted into said elongated and enclosed cavity formed between said transparent circular tubes;

arranging the at least one solid state light source on a light source carrier; and arranging the light source carrier adjacent to and adjoining the at least two sealed transparent tubes so that the at least one solid state light source is confined in an enclosure formed by the light source carrier and the at least two transparent tubes.

14. The method according to claim 13, wherein the wavelength converting material is provided in the form of a solid rod comprising an organic phosphor polymer.

15. The method according to claim 13, wherein the transparent tubes are glass tubes.

16. The method according to claim 13, wherein said cavity is completely enclosed.

* * * * *